US008844221B2

(12) United States Patent
Duerig et al.

(10) Patent No.: US 8,844,221 B2
(45) Date of Patent: Sep. 30, 2014

(54) ARRANGEMENT FOR A LABORATORY ROOM

(75) Inventors: Urs T. Duerig, Rueschlikon (CH); Bernd W. Gotsmann, Rueschlikon (CH); Emanuel Loertscher, Rueschlikon (CH); Daniel Widmer, Rueschlikon (CH)

(73) Assignee: International Business Machines Corporation, Armonk, NY (US)

( * ) Notice: Subject to any disclaimer, the term of this patent is extended or adjusted under 35 U.S.C. 154(b) by 220 days.

(21) Appl. No.: 13/466,205

(22) Filed: May 8, 2012

(65) Prior Publication Data

US 2012/0291376 A1 Nov. 22, 2012

(30) Foreign Application Priority Data

May 17, 2011 (EP) ..... 11166421

(51) Int. Cl.
*F24F 7/10* (2006.01)
*B01L 1/04* (2006.01)

(52) U.S. Cl.
CPC ..... *B01L 1/04* (2013.01); *F24F 2221/40* (2013.01); *F24F 7/10* (2013.01); *B01L 2200/0636* (2013.01)
USPC ..... 52/220.8; 52/220.2; 52/302.1; 361/691; 361/694; 165/80.3; 454/187; 454/185; 454/186

(58) Field of Classification Search
USPC ..... 52/220.6, 220.1, 263, 126.5, 126.2, 52/220.2, 220.3, 220.8, 220.5, 302.1, 52/302.3; 248/346.01, 188.1, 188.2; 361/688, 695, 700, 701, 702, 690, 694, 361/693, 691, 692; 62/259.2, 263; 165/80.3, 104.33; 454/184, 187, 185, 454/186
See application file for complete search history.

(56) References Cited

U.S. PATENT DOCUMENTS

| | | | | |
|---|---|---|---|---|
| 5,692,954 | A * | 12/1997 | Lee et al. | 454/187 |
| 6,574,970 | B2 * | 6/2003 | Spinazzola et al. | 62/89 |
| 6,612,084 | B2 * | 9/2003 | Rapisarda et al. | 52/630 |
| 6,669,163 | B2 * | 12/2003 | Davis, Jr. | 248/346.01 |
| 6,745,579 | B2 * | 6/2004 | Spinazzola et al. | 62/89 |
| 7,568,360 | B1 * | 8/2009 | Bash et al. | 62/186 |
| 8,434,804 | B2 * | 5/2013 | Slessman | 296/24.3 |
| 8,498,114 | B2 * | 7/2013 | Martini | 361/695 |
| 8,641,492 | B2 * | 2/2014 | Meyer | 454/184 |
| 2002/0059804 | A1 * | 5/2002 | Spinazzola et al. | 62/259.2 |
| 2003/0177724 | A1 * | 9/2003 | Botting | 52/302.1 |
| 2005/0225936 | A1 * | 10/2005 | Day | 361/687 |
| 2010/0041327 | A1 * | 2/2010 | Desler | 454/184 |

* cited by examiner

*Primary Examiner* — Chi Q Nguyen
(74) *Attorney, Agent, or Firm* — Cantor Colburn LLP

(57) ABSTRACT

An arrangement for a laboratory room that is confined by a floor, a ceiling and walls connecting the floor with the ceiling, the arrangement comprises: a main base suspended on the floor; a tool base arranged on the main base; a platform arranged around the tool base, wherein the platform is permeable for air, and the platform is suspended at the walls; an air inlet arranged below the platform; an air outlet arranged above the tool base; and air guides for directing an air flow upwards at least partially parallel to the main base and/or the tool base.

13 Claims, 5 Drawing Sheets

ARRANGEMENT FOR A LABORATORY ROOM

PRIORITY

This application claims priority to European Patent Application No. 11166421.5, filed 17 May 2011, and all the benefits accruing therefrom under 35 U.S.C. §119, the contents of which in its entirety are herein incorporated by reference.

BACKGROUND

This disclosure relates to an arrangement for a laboratory room and a method for operating an arrangement for a laboratory room.

Modern laboratory rooms, as for example clean room facilities, need particularly clean and isolated environments. For example, nanotechnology experiments are extremely sensitive and need to be screened from disturbances. Therefore, laboratories should be insulated as much as possible from external disturbances. Researchers feel it desirable to have vibration acoustic effect minimized, electromagnetic fields reduced and fluctuations in the temperature and humidity minimized. Hence, one may call the desired experimental environment a noise-free lab.

Conventionally, active and passive isolation systems are utilized to reduce external influences affecting the interior of a laboratory room.

BRIEF SUMMARY

In one embodiment, an arrangement for a laboratory room that is confined by a floor, a ceiling and walls connecting the floor with the ceiling, the arrangement including a main base suspended on the floor; a tool base arranged on the main base; a platform arranged around the tool base, wherein the platform is permeable for air, and the platform is suspended at the walls; an air inlet arranged below the platform; an air outlet arranged above the tool base; and air guides for directing an air flow upwards.

BRIEF DESCRIPTION OF THE DRAWINGS

In the following, embodiments of arrangements for laboratory rooms and methods relating to the operation of such arrangements are described with reference to the enclosed drawings.

Like or functionally like elements in the drawings have been allotted the same reference characters, if not otherwise indicated.

DETAILED DESCRIPTION

Figure 1:
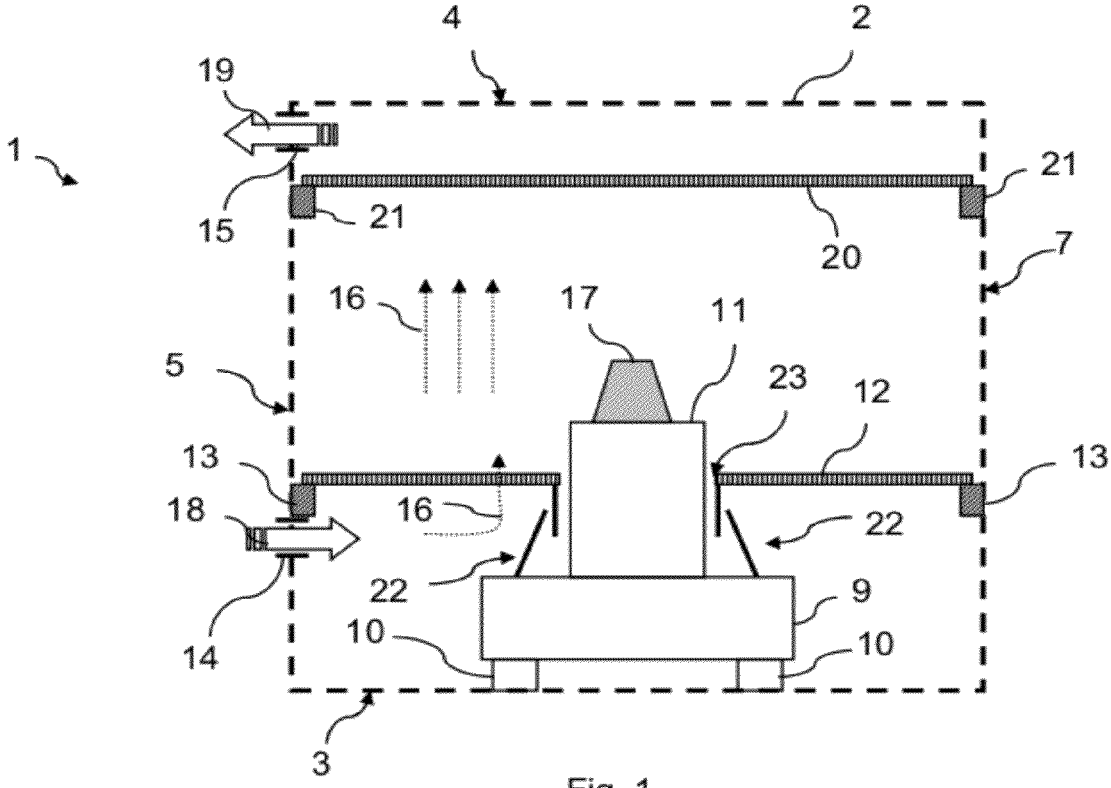
FIG. 1 shows a schematic diagram of a first embodiment of a lab arrangement in a sectional view.

It is an aspect of the present disclosure to provide improved arrangements for laboratory rooms.

According to an embodiment of a first aspect of the invention an arrangement for a laboratory room that is confined by a floor, a ceiling and walls connecting the floor with the ceiling is disclosed.

The arrangement comprises: a main base suspended on the floor, a tool base arranged on the main base; a platform arranged around the tool base, wherein the platform is permeable for air, and the platform is suspended at the walls; an air inlet arranged below the platform; an air outlet arranged above the tool base; and air guides for directing an air flow upwards.

According to an embodiment the air guides are arranged below the platform for directing or guiding the air flow from the air inlet upwards to the platform.

According to an embodiment the arrangement is suitable, for example, for a cuboid-shaped laboratory room that has concrete walls, floors and ceilings.

According to an embodiment the air guides are arranged for directing the air flow upwards at least partially parallel to the main base and/or the tool base.

As used herein the term "laboratory room" or "lab room" may refer to any room or confinement where isolation from external influences is desired. For example, a fabrication facility, a clean room, a measurement chamber, gauging facility or the like may be considered a "lab room".

According to an embodiment the main base on which the tool base is arranged isolates against vibrations due to its preferably large mass and a suspension system. The suspension may be active or passive. For example, one may contemplate of a suspension in terms of controlled actuation devices that compensate detected vibrations coupled to the laboratory room confinement. The tool base is preferably adapted to carry machinery and/or transportation devices.

A platform may be, for example, an intermediate floor that is suitable to be walked on by, for example, an operator, a user, a scientist or researcher, inside the laboratory room. Preferably, the platform is further adapted to support transportation devices, machinery and/or other equipment used in the room. The platform is permeable for air, for example in terms of tiny openings or through holes such that air, as for example, conditioned air, may pass vertically through the platform. The resulting air flow is preferably a laminar flow with minimized turbulence. The platform is suspended at the walls, e.g., in terms of supporting beams or fixtures.

According to an embodiment, the floor of the laboratory room, the ceiling and the platform are arranged in parallel to each other and horizontally situated. The walls may be oriented vertically with respect to gravity.

"Below" or "above" is to be understood as having a lower or higher level in a vertical direction, i.e., with respect to gravity. For example, due to the position of the air inlet at a lower level with respect to the platform, conditioned air may enter the laboratory room from below and rises upwards to be drawn of from the room through the outlet.

The air guides preferably prevent an air flow from impinging, more or less perpendicularly, to a surface of the main base or the tool base. As a result, the air conditioning and the vibration isolation can be decoupled from each other. According to an embodiment a direct air flow against the main base and/or the tool base is substantially prevented by the air guides. This can avoid a vibrational excitation of the main base and/or the tool base by the air flow.

Some embodiments provide the air inlet below the platform and above the main base.

In embodiments of the arrangement, the arrangement is operable to provide an air flow from the inlet, through the platform to the outlet. Since the outlet is preferably arranged at a level, for example, in the ceiling or at wall portions, higher than the main base or the tool base, the ventilation of air is realized from bottom to top. Hence, an essentially laminar air flow that starts vertically through the platform is sucked out at an upper part of the laboratory room. This may be implemented, for example, by a pressure difference between the air inlet and the air outlet.

The main base may be, for example, suspended by air springs. One may also contemplate of other suspensions, as for example, actor suspensions where the actuator may provide for an anti-sound for reducing or compensating vibrations or noise.

Preferably, a gap is provided between the platform and the tool base. As a result, there is no mechanical or rigid body coupling between the platform and the tool base. Therefore, the influence of an operator or user walking on the platform to the experimental setup on the tool base is minimized or prevented.

In embodiments of the arrangement the air inlet is provided above the main base. Hence, a potential air flow is arranged between the intermediate floor, or platform, to the ceiling. This direction of an air stream is, for example, compatible with natural convection which leads warmed-up air to rise. Hence, an air flow from bottom to top minimizes acoustic noise or turbulences. Essentially, a laminar air flow is realized according to an embodiment.

Embodiments of the arrangement may comprise air guides that include a shielding structure arranged between the main base and the platform, wherein the shielding structure surrounds the tool base for shielding the tool base from an air flow. The shielding structure can have the form of an apron or flange that prevents air from directly impinging on the surface of the tool base potentially causing vibrations.

According to an embodiment, the shielding structure comprises an upper frame protruding from the platform and a lower frame protruding from the main base. For example, the upper frame and the lower frame may extend towards each other. Hence, the upper frame stretches from the down surface of the platform towards the floor of the laboratory room while the lower frame protrudes from a main base upwards. The upper frame and the lower frame preferably do not touch each other. However, the two frames can overlap for realizing an air-flow tight apron or flange. For example, in some embodiments there is a horizontal gap between the upper frame and the lower frame in.

This non-contact flange system or apron prevents air flow around the tool base and reduces a vibration and excitation of the main base. Because the two parts are not rigidly coupled the user or operator walking on the platform does not excite the tool base and/or tool. The guiding structure prevents direct air flow against the main base and/or the tool base.

In embodiments of the apron-like shielding structure a bottom part has through holes for cables and/or tubes. Since the lower frame is attached to the main base, one can attach cables in a stiff manner to the main base. This allows the tool or experiment to be wired without interfering with the shielding structure, the air flow or the vibration isolation. When cables are not free-hanging but attached to the main base, vibrations can be reduced.

In other embodiments, the guiding structure comprises a plurality of ducts for guiding air from the inlet to the platform. Preferably the ducts guide the air such that an air flow flows substantially normal through openings in the platform. The ducts may be implemented as tubes, hoses, conduits or the like.

For example, a plurality of ducts or tubes may guide conditioned air to openings in the platform. As a result, air flows substantially vertically from the platform towards the ceiling of the room.

Other embodiments of the arrangements further comprise a suspended ceiling arranged below the air outlet. Preferably, the suspended ceiling is permeable for the air. For example, there may be openings in the suspended ceiling. Embodiments of the suspended ceiling comprise a cooling web or fin for cooling air. The ceiling having an integrated cooling function may replace an external air condition device so that noise stemming from conditioning means is reduced and preferably eliminated. Air that may be heated by the tool or experiment at or on the tool base rising from the bottom region of the lab room to its top is then efficiently cooled, and the heat load is drawn out of the interior of the laboratory room.

The arrangement may further comprise an opening below the air inlet for passing cables. Additional openings that are cladded by an isolating material may be provided in the main base.

Embodiments of the arrangement have the walls cladded with a mu-metal. The mu-metal leads to a good electromagnetic isolation and prevents external electromagnetic fields from penetrating through the walls, floor or ceiling into the laboratory. The mu-metal cladding leads to both an electrostatic and magnetic screening.

Embodiments of the arrangement may further comprise one or more of the following features: cooling ceiling, a loaded air spring as suspension for the tool and/or the main base, sound absorbing wall coatings, efficient LED illumination, compensating Helmholtz coils for compensating internal electromagnetic fields in the room, air conditioning devices preferably outside the room for cooling and dehumidifying air, non-magnetic reinforcements for the main base, as for example a glass fiber enforcement, perforated plates or segments in the platform allowing for air permeability, passages for cables and wise in the main base and/or the lower frame of the shielding structure, water cooling elements in or above the suspended ceiling, DC current power supplies for illumination devices or fans, wooden floor bars or beams, active or passive sound suppressing devices.

According to an embodiment of a further aspect a method for operating an arrangement for a laboratory room is provided, wherein the laboratory room is confined by a floor, a ceiling and walls connecting the floor with the ceiling. The arrangement comprises at least a main base suspended on the floor, a tool base arranged on the main base, a platform arranged around the tool base wherein the platform is permeable for air and the platform is suspended at the walls, an air inlet arranged below the platform, an air outlet arranged above the tool base and guides for directing an air flow upwards at least partially parallel to the main base and/or the tool base. The method comprises: inducing an air flow from the air inlet through the platform to the air outlet in a substantially laminar fashion.

The method may further comprise cooling or conditioning air, feeding air to the air inlet, decreasing the temperature of air above the tool, cooling air above the tool base and, in particular, above a suspended ceiling, preventing a direct air flow against the main base and/or the tool base, eliminating low frequency contributions in wires or cables in the room.

Certain embodiments of the presented arrangement and the method for operating the arrangement may comprise individual or combined features, method steps or aspects as mentioned above or below with respect to exemplary embodiments.

Figure 2:
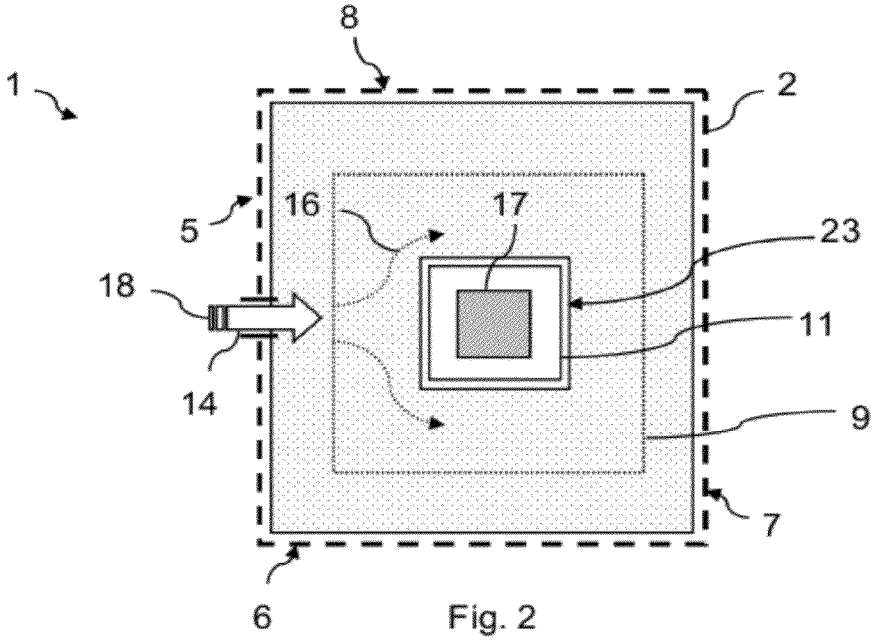
FIG. 2 shows a schematic diagram of the first embodiment of a lab arrangement in a top view.

FIG. 1 shows a schematic diagram of a first embodiment of a lab arrangement in sectional view. FIG. 2 shows the first embodiment in a top view.

FIG. 1 illustrates a laboratory room that is, for instance, suitable for nanotechnology experiments that are extremely sensitive to external noise. Therefore, an embodiment of an arrangement 1 for a laboratory room 2 is provided. The laboratory room 2 is confined by a (ground) floor 3, a ceiling 4 and walls 5, 6, 7, 8 that extend between the floor 3 and the ceiling 4. The confining walls are made of concrete, for example, and can have certain reinforcements. The reinforcement or armoring can be plastic-based but also implemented in terms of a metal grid. One may use fiber glass as reinforcement material.

For improving the isolation with respect to external noise or disturbances, the laboratory room 2 is insulated and shielded through a plurality of measures. The arrangements provide for vibration isolation, temperature and humidity control, and electromagnetic screening.

Inside the laboratory room 2 a main base 9 is suspended, for example, by means of a pneumatic suspension 10 on the floor 3. The main base 9 may be pneumatically damped, for instance, by air coils or air springs 10. The main base 9 can also be actively controlled. An active suspension control may include actor devices, controllable springs and the like. For example, the main base is made of concrete and weighs between 30 and 80 tons. The main base 9 may be implemented as a concrete block which is reinforced by non-magnetic material. One may contemplate of glass fiber reinforcements for the main base 9.

The floor 3 can occupy a space of approximately 5 by 5 meters, wherein the main base 9 covers about 80% of the floor 3. The walls 5, 6, 7, 8 may have a height of eight meters as well.

A tool base 11 is suspended onto the main base 9 and is suitable for carrying the actual experiment or tool 17 used by the operators or scientists inside the laboratory room. The tool base 11 may weigh between 2 and 5 tons and covers about 20%-30% of the entire room area. The main base 9 may weigh approximately 8-10 times the tool base weight. Larger ratios between the main base weight and the tool base weight can improve the vibration damping effects.

There is a platform or intermediate floor 12 arranged around the tool base 11 allowing access to the actual tool experiment or measurement setup 17. The floor 12 is mechanically decoupled from the main base 9 and the tool base 11 by a gap 23. It is suspended at the sidewalls 5, 6, 7, 8. For example, wooden or non-magnetic beams, bars or timbers can be used to support the platform 12. The platform 12 itself is permeable for air. Hence, the platform 12 divides the laboratory room into a lower part below the platform 12 and an upper part above the platform 12. A person, user, scientist or operator of the laboratory equipment 17 may stand and walk on the floor of the platform 12. As the platform 12 is arranged to be air permeable, for example by use of perforated plates, through-holes in the floor, a fleece or membrane material, pressure exchange between the lower part and the upper part is available.

There is further a suspended ceiling 20 above the tool 17 and below the ceiling 4. For example, the intermediate or suspended ceiling 20 is suspended on bars 21. The ceiling 20 is preferably air-permeable. The platform 12 and the suspended ceiling 20 divide the room 2 vertically into sections, and a pressure exchange may occur between the sections in the lab room 2.

The arrangement 1 for the laboratory room 2 includes an air inlet 14 which is situated below the platform 12 and preferably above, i.e., on a higher level than the highest surface of the main base 9. The air inlet 14 allows for the entry of conditioned air 18 into the laboratory room 2. An air outlet 15 is provided above the tool 17, and more preferably, above the suspended ceiling 20. The air outlet 15 allows for drawing out air 19 from the laboratory room interior. An air conditioning device (not shown) is situated outside of the laboratory room 2 and provides the temperature adapted and dehumidified air 19 to the inlet 14. The temperature inside the laboratory room 2 may be controlled through the external air conditioning within a range of 0.2° C. of the desired temperature.

There are air guides 22 that direct an air flow 16 upwards at least partially parallel to a vertical surface of the main base 9 and eventually vertically upwards. One can see in FIGS. 1 and 2 that there is a gap 23 between the platform 12 and the tool base 11. Hence, there is no mechanic coupling between the platform 12 and tool base 11 and the tool or experiment 17 (a slight acceptable coupling may be present through the walls 7, 5, floor 3, and suspension system 10). Hence, the tool is vibrationally decoupled from the platform 12. Through the air guides 22 and the arrangement of the inlet 14 below the platform 12 and above the main base 9, a laminar air flow or stream 16 runs from the platform 12 up to the ceiling 20. This is indicated by the dotted arrows 16. The air guides 22 basically prevent that a direct air flow impinges against the main base 9 and the tool base 11. Therefore, the air conditioning, or temperature and humidity control, inside the laboratory room 2 is decoupled from the experimental setup in terms of the main base 9, the tool base 11 and the experimental tool 17.

The temperature can be controlled within a range of 0.2° C. or, if required, also within a range of 0.1° C. A typical air stream 18 at the inlet 14 is between 0.1 m/s and 0.4 m/s depending on the size of the air inlet. Preferably, the air stream 18 is between 0 and 0.1 m/s. For example, the resulting air stream from the platform to the ceiling is 0.05 m/s. Since the air flows from the floor 3 to the ceiling 4, for example, between the platform 12 and the suspended ceiling 20 in a laminar fashion air that is heated, for example, by the experimental tool 17, runs along the physical convection. Hence, turbulences can be reduced or minimized.

The setup or arrangement 1 depicted in FIGS. 1 and 2 may serve as an exploratory clean room facility or a laboratory room which is almost noise free and shielded against external and internal vibrations, acoustic noise, temperature fluctuations and potentially also against electromagnetic fields, for example, by an appropriate cladding of the walls 3-8. The homogeneous flow air conditioning system reduces disturbances to a minimum.

Figure 3:
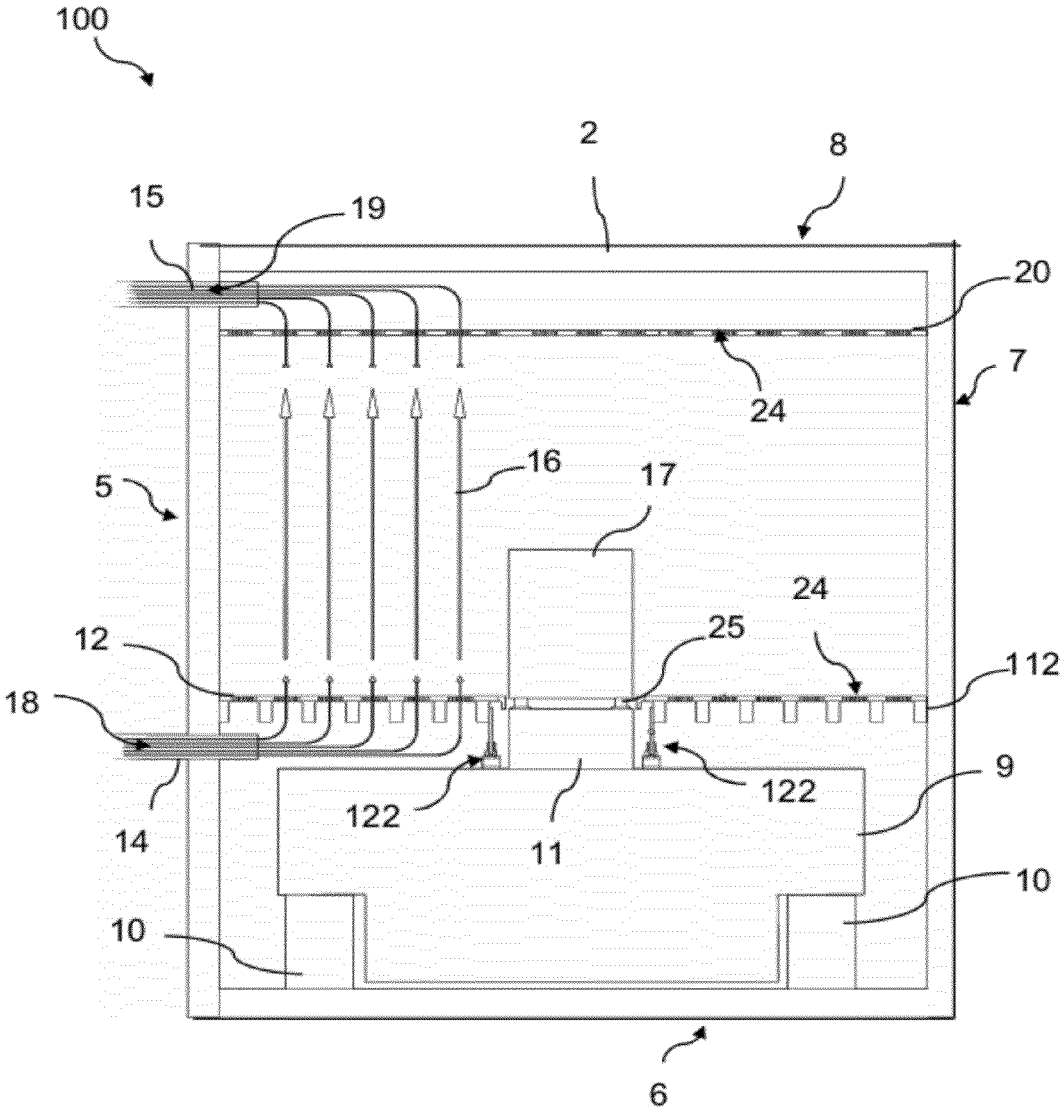
FIG. 3 shows a schematic diagram of a second embodiment of a lab arrangement in a sectional view.

FIG. 3 shows a schematic diagram of a second embodiment of a lab arrangement in a sectional view. The laboratory room 2 is shown with a floor 6, a ceiling 8 and side walls 5, 7. A solid and potentially reinforced concrete main base 9 is suspended on the floor 6. The suspension can be realized in terms of air springs 10 which may be actively controlled. Hence, there can be a control mechanism which is not shown in FIG. 3 for compensating vibrations. The tool base 11 is placed on top of the main base 9 for carrying the tool or experiment 17 which is suspended, for example, by air springs 25.

A platform 12 is supported by wooden balks or beams 112 which are mounted at the side walls 5, 7. There is no mechanical coupling between the platform 12 and the tool 17 or tool base 11. The platform 12 is air-permeable by air through holes or perforations 24. Similarly, a suspended ceiling 20 is provided with perforations or openings 24 allowing an air flow through the ceiling 20. The air inlet 14 is situated on a level of the tool base 11 and allows for conditioned air 18 to enter the interior of the laboratory room 2. The air outlet 15 is situated above the suspended ceiling 20. Air 19 can be drawn out or sucked out through the outlet 15.

Figure 4:
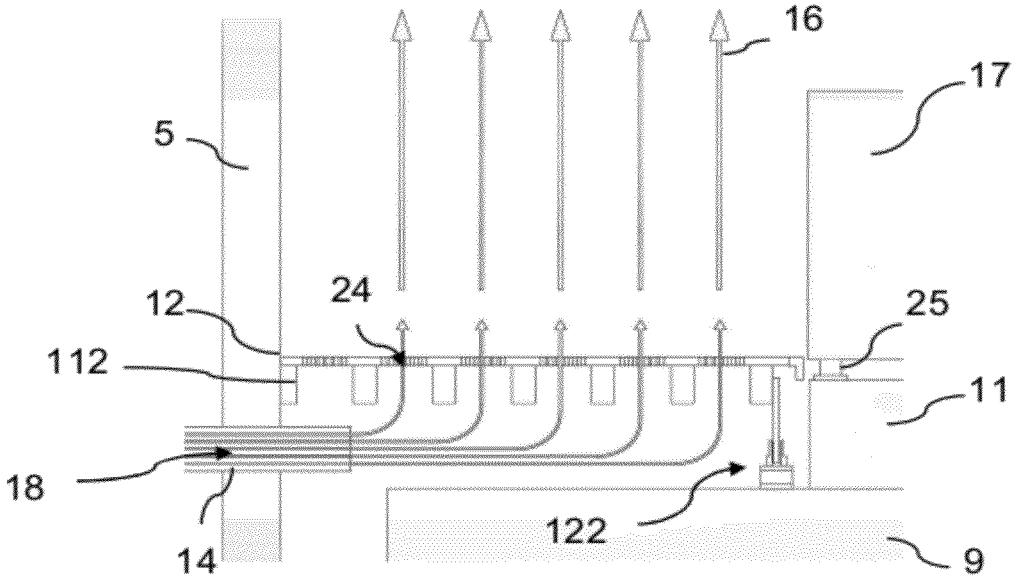
FIG. 4 shows a sectional view of a first embodiment of air guides for a lab arrangement.

Around the tool base 11 an air-guiding structure 122 is placed. A more detailed sectional view of the apron-like air guides 122 is shown in FIG. 4. FIG. 4 shows how incoming air 18 is let into the space between the main base 9 and the platform 12. The air guides 122 prevent incoming air 18 from running towards the tool base 11. Essentially, the conditioned incoming air 18 flows upwards along the arrows 16. The air flow is preferably regular and laminar. In embodiments, the air flow is stationary having a constant flow in time.

Figure 5:
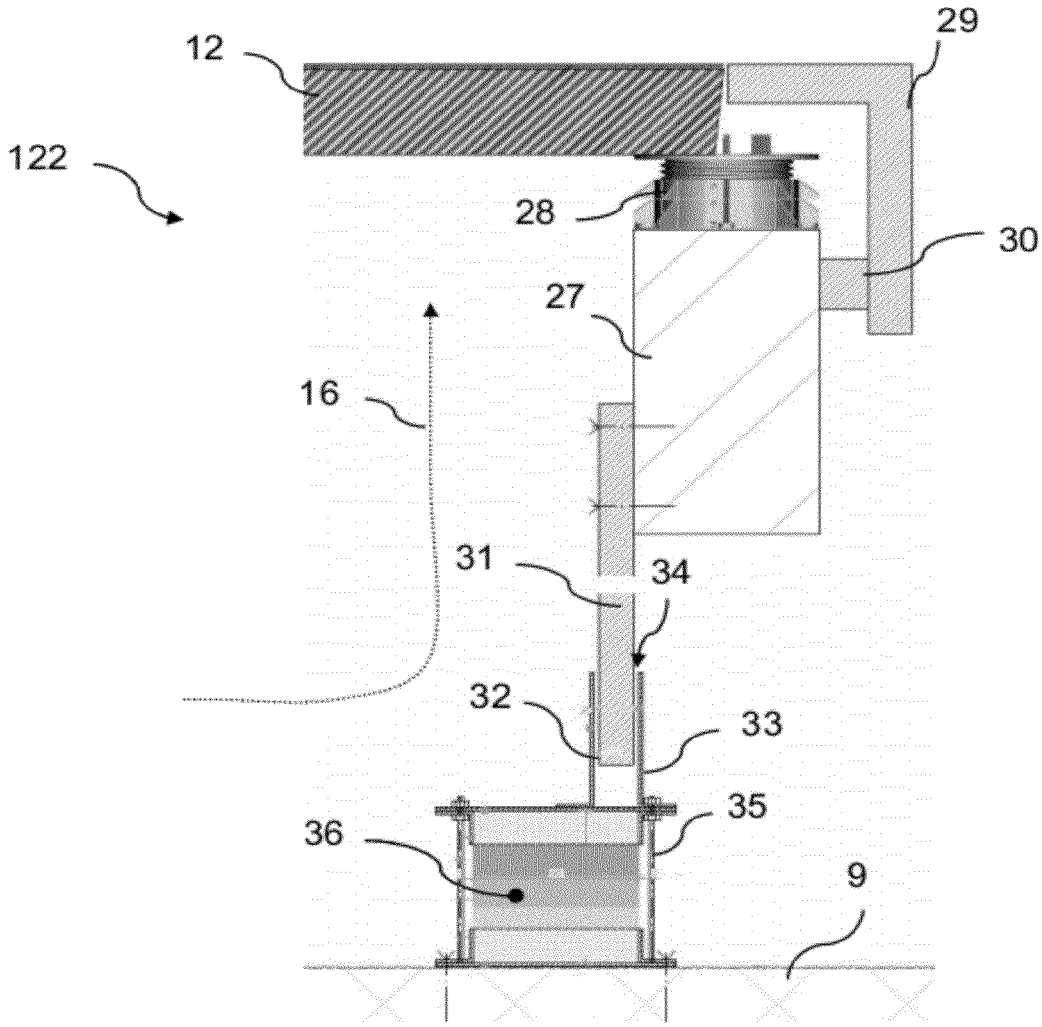
FIG. 5 shows a more detailed sectional view of the first embodiment of air guides.

FIG. 5 shows a more detailed sectional view of the first embodiment of the air guides 122. FIG. 5 shows the section between the platform 12 and the main base 9 of FIG. 4. At the edge of the platform 12 where the opening for the tool base is situated, a frame surrounding the tool base and protruding downwards is arranged. The frame comprises several elements 27-31. From the main base 9, a lower frame also comprising several elements 31-38 protrudes upwards. The upper frame 27-31 and the lower frame 31-36 provide for an air-flow tight apron around the tool base. The apron-like structure can be called a flange.

For example, a coupling device 28 is attached to the lower surface of the platform 12 and holding a wooden beam 27. A board 31 is attached to the beam 27 and reaches towards the main base 9. An aluminum angle 29 coupled by a wooden coupling piece 30 to the beam 27 provides for a closure around the tool base. The edge of the angle 29 surrounds the tool base. Although, shown as a sectional view in FIG. 5, the apron or flange 122 may have rectangular form surrounding the tool base 11. The board 31 reaches into a slit formed by two aluminum profiles 31 and 32 which are secured through a coupling socket 35. The two aluminum profiles 31, 32 are plate like and arranged in parallel thereby forming a slit in which the boards 34 reaches into. Instead of two aluminum profiles 31, 32, a U-profile can be used.

The board 31 is not in contact with either one of the aluminum profiles 32 and 33. Rather, there is a gap 34 between the board 31 of the upper frame and the two aluminum profiles 32, 33 of the lower frame. Hence, the platform 12 remains vibrationally decoupled from the main base 9.

Nevertheless, an air flow 16 is diverted upwards through the apron 122. As a result, a laminar upward air flow 16 develops as indicated in FIGS. 3 and 4. The air-conditioned air which potentially carries disturbances is isolated from the tool base 11 and thereby from the tool or experiment 17. In the lower socket 35 a feed-through or passage 36, for example for cables or wires are provided. Therefore, a wiring of the tool or experiment 17 may run through the lower socket 35.

Figure 6:
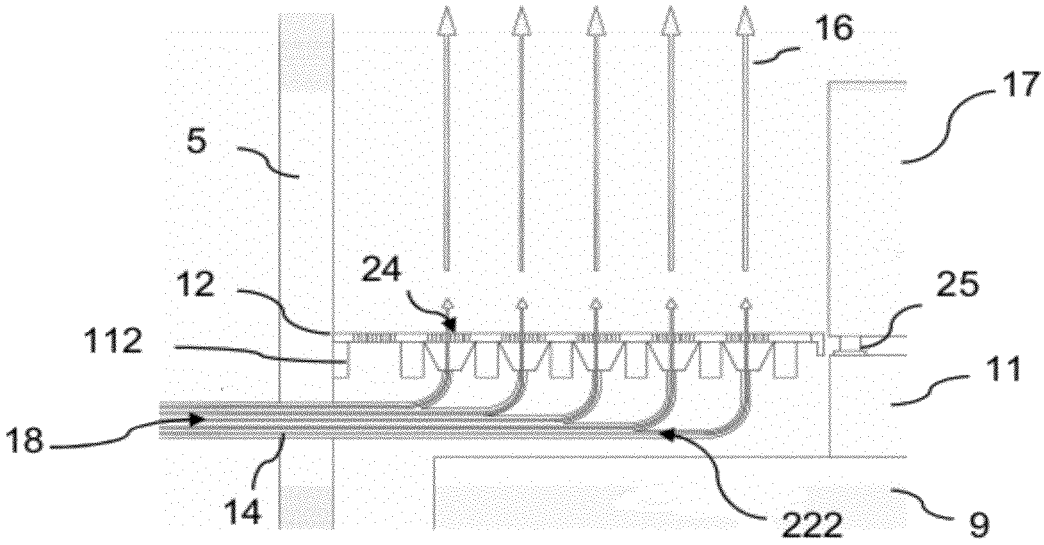
FIG. 6 shows a sectional view of a second embodiment of air guides for a lab arrangement.

FIG. 6 shows a sectional view of a second embodiment of air guides for a lab arrangement. Instead or in addition to the apron-like air guides depicted in FIGS. 4 and 5, one may contemplate of providing a plurality of ducts or tubes from the air inlet 14 to the perforations 24 in the platform 12. For example, air pipes 222 can direct the conditioned air 18 directly to the openings 24 in the platform 12 such that the air flows vertically upwards. By using such ducts, pipes or hoses for the air flow to the platform 12, the air is prevented from directly flowing against the tool base 11 or the experiment 17. Rather, the air stream follows the natural convection inside the interior of the laboratory room. The tubes or hoses 222 can couple to nozzles in the platform 12 such that a vertical air flow is guaranteed. Thus, an improved isolation and reduced noise may be accomplished. Eventually, the air can be drawn out at an air outlet as, for example, shown in FIG. 3.

Figure 7:
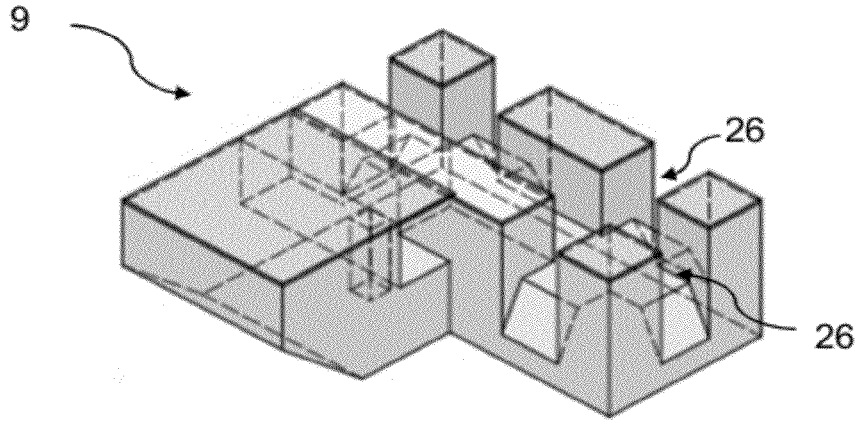
FIG. 7 shows a perspective view of an embodiment of a main base for a lab arrangement.

FIG. 7 illustrates an embodiment of a main base structure. The main base 9 has an irregular shape for reducing vibrational modes at high frequencies. The embodiment of a main base 9 has trenches 26 that can be used as passages for guiding cables or wirings through the lower part of a laboratory room. The main base may include concrete that is potentially armored. In an embodiment, the concrete block forming the main base 9 does not include magnetic materials. It has been found that, for example, instead of using conventional steel reinforcement, a special plastic, e.g., fiber reinforced plastic, can be employed as rebar. For example, one may use a glass fiber enforcement for the concrete block used as a main base 9.

Figure 8:
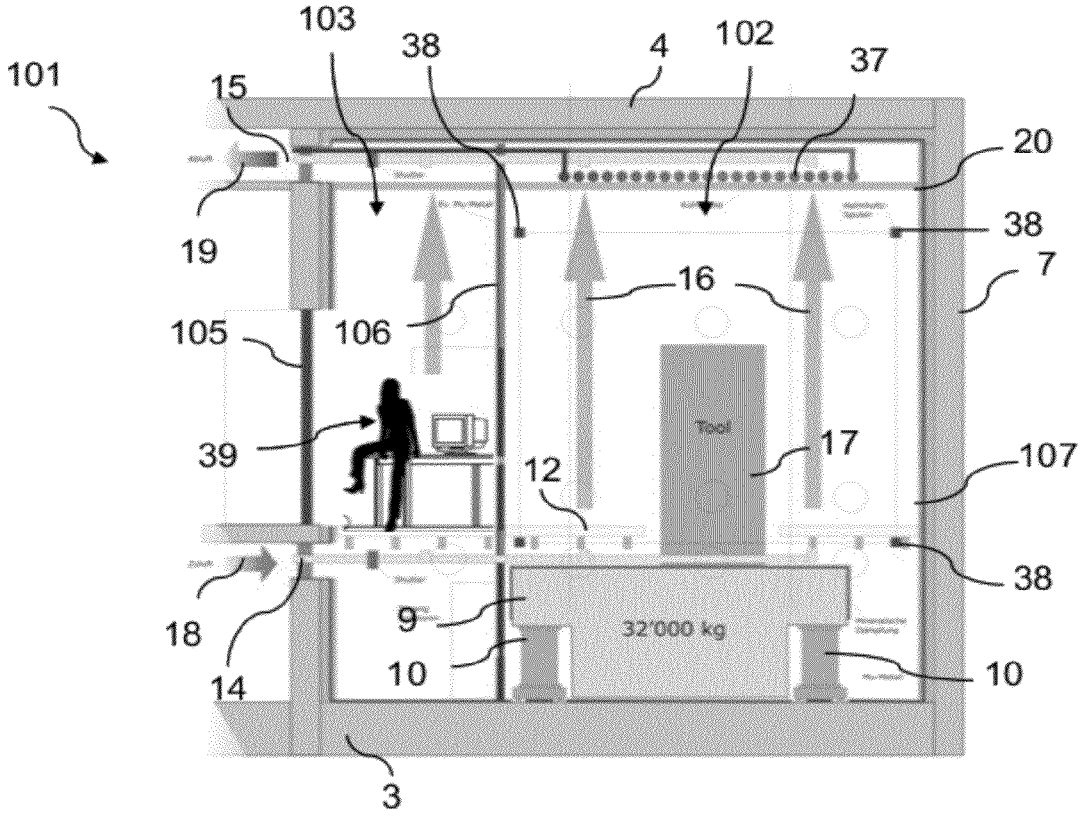
FIG. 8 shows a schematic diagram of a third embodiment of a lab arrangement in a sectional view.
Figure 9:
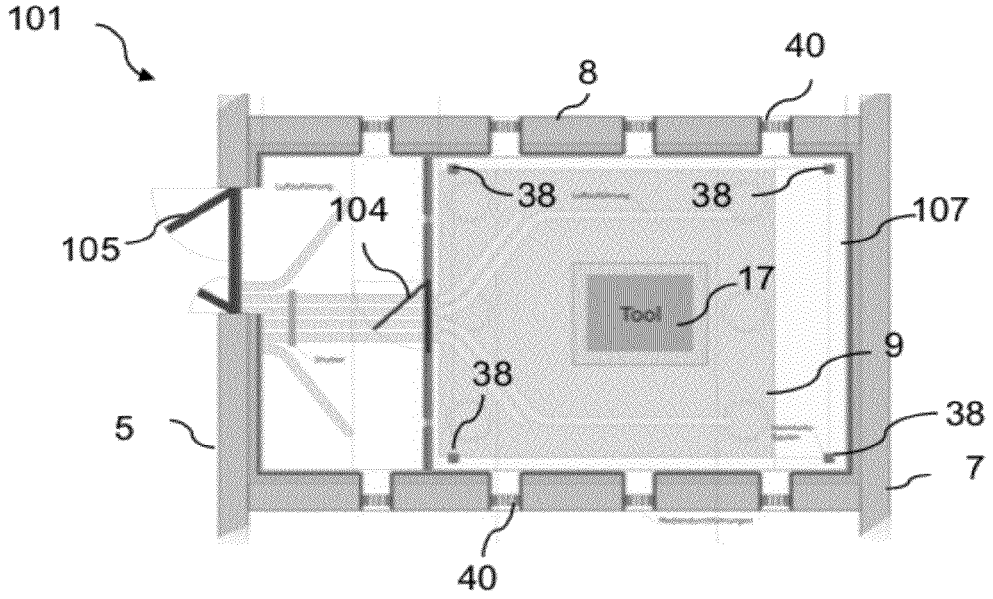
FIG. 9 shows a schematic diagram of the third embodiment of a lab arrangement in a top view.

FIG. 8 shows a schematic diagram of a third embodiment of a lab arrangement in a sectional view. FIG. 9 shows the third embodiment in a top view. The embodiment or lab arrangement 101 comprises a laboratory room with similar features as shown in FIG. 3. Additionally, there is an intermediate wall 106 separating that laboratory room into an experimental space 102 which is shown on the right-hand side in the orientation of FIGS. 6 and 7 and an ante or operating room 103 to the left. By providing an intermediate wall 106, the influence of an operator 39 in the ante room 103 can be reduced. FIGS. 6 and 7 illustrate a door 105 that allows the operator 39 to enter the ante room 103. There is another door or door way 104 that allows access to the actually experimental setup 17 in the experimental space 102.

The air guides for creating a laminar air flow 16 from bottom to top are not explicitly shown and can be implemented as depicted above. In addition to the vibrational isolation by using the heavy main base 9 and a controlled flow of air 16, the walls, the floor 3 and the ceiling 4 of the interior are furnished with a metal shielding 107. The metal shielding 107 provides for an electromagnetic field rejection and allows for a practically electromagnetic noise-free environment inside the laboratory room 102, 103. For example, the metal shielding 107 includes a mu-metal. Mu-metals have a very high magnetic permeability and therefore allow for an efficient screening of oscillating magnetic fields.

Additionally, Helmholtz coils 38 are provided in the direction of all space axes (x, y, z), for example in the corners of the room(s) 102, 103 and/or optionally at several other places inside. The coils 38 are controlled to compensate for electromagnetic disturbances arising inside the laboratory room 102, 103. The coils 38 may also compensate for DC components of stray fields from the outside.

The operator or entry room 103 is preferably acoustically, electro-magnetically, vibrationally and thermally decoupled from the experimental room 102, where the experimental setups 17 are installed.

Further, the suspended ceiling 20 is provided with water cooling elements or fins 37. The temperature inside the lab can be adjusted by heating or cooling the uprising air 16 in the vicinity of the suspended ceiling 20. By using a cooling arrangement in or at the ceiling 4, 20 in terms of the fins 37, warmed-up air, for example, during operation of an experiment, can be cooled before sucked or drawn out through the outlet.

When operating a laboratory room, the air flow may be arranged from bottom to top. This allows for a laminar air stream 16 without coupling the air carrying acoustic noise to the main base 9 or tool (base) 11, 17. Hence, the experiment may be carried out in a vertically noise-free environment. Further, during the operation cables and wires leading inside or outside the enclosure of the laboratory room 102 do not carry low-frequency currents or emit mid-low frequency radiation. Additionally, sound absorbing coatings can be applied to the surfaces inside the laboratory room, and preferably LED or FL illumination is used inside the lab room. Optionally, cranes or auxiliary equipment, for example, for moving the experimental setup can be installed and included into the arrangements shown.

Referring to FIGS. 8 and 9, the air conditioning for the ante or operating room 103 is preferably separate from the air conditioning of the actual experimental setup room 102.

Embodiments of the arrangement of the laboratory room provide for a virtually noise free lab environment. Temperature stability is ensured by the cylindrical air conditioning system based on a laminar air flow without causing turbulences. Floor vibrations a decoupled from the actual experiment by the platform which is mechanically decoupled from the main base and the tool base. Vibrations are reduced by the heavy main base. Electromagnetic fields are shielded by preferably a mu-metal cladding and actively controlled Helmholtz coils for compensating internal fields in the room. Further, various stages or sound suppressors can be used to reduce the acoustic noise. Further, a cooling ceiling that in principle may make a noise prone air conditioning obsolete. Using the cooling ceiling, the temperature control of the interior of the laboratory room can be realized by convection.

One may add acoustically damping materials at the walls, the ceiling, the tool base, the main base etc. to reduce acoustic emissions from the experiment. Sound reflection at walls and ceiling can therefore be reduced. Also a potential sound emission from the air-spring suspended main base can be reduced by special coatings.

LIST OF REFERENCE CHARACTERS

1 lab arrangement
2 laboratory room
3 floor
4 ceiling
5, 6, 7, 8 wall
9 main base
10 suspension
11 tool base
12 platform
13 suspension
14 air inlet
15 air outlet
16 air flow
17 tool/experimental setup
18 inflowing air
19 outflowing air
20 suspended ceiling
21 suspension
22 air guides
23 gap
24 through holes
25 suspension
26 passage/trench
27 bar
28 coupling device
29 angle profile
30 bar
31 frame
32, 33 slit
34 gap
35 socket
36 cable channel/passage
37 cooling fins
38 Helmholtz coils
39 operator
40 opening
100, 101 lab arrangement
102 experimental room
103 ante room
104 door way
105 door
106 wall
107 metal cladding
112 bar
122 flange/apron
222 ducts

The invention claimed is:

1. An arrangement for a laboratory room that is confined by a floor, a ceiling and walls connecting the floor with the ceiling, the arrangement comprising:
- a main base suspended on the floor;
- a tool base arranged on the main base;
- a platform arranged around the tool base, wherein the platform is permeable for air, and the platform is suspended at the walls;
- an air inlet arranged below the platform;
- an air outlet arranged above the tool base; and
- air guides configured to direct an air flow upwards, the air guides comprising a shielding structure arranged between the main base and the platform, the shielding structure surrounding the tool base for shielding the tool base from an air flow.

2. The arrangement of claim 1, wherein the arrangement is operable to provide an air flow from the inlet, through the platform to the outlet and wherein the air guides are arranged for directing the air flow upwards at least partially parallel to at least one of the main base and the tool base.

3. The arrangement of claim 1, wherein the main base is suspended by air springs.

4. The arrangement of claim 1, wherein a gap is provided between the platform and the tool base.

5. The arrangement of claim 1, wherein the air inlet is provided above the main base.

6. The arrangement of claim 1, wherein the shielding structure comprises an upper frame protruding from the platform and a lower frame protruding from the main base.

7. The arrangement of claim 6, wherein there is a gap between the upper frame and the lower frame such that the frames do not touch each other.

8. The arrangement of claim 1, wherein the air guides comprises a plurality of ducts for guiding air from the inlet to the platform.

9. The arrangement of claim 1, further comprising a suspended ceiling arranged below the air outlet.

10. The arrangement of claim 9, wherein the suspended ceiling comprises a cooling fin.

11. The arrangement of claim 1, further comprising an opening below the air inlet for passing cables.

12. The arrangement of claim 1, wherein the main base comprises a non-magnetic reinforcement.

13. The arrangement of claim 1, wherein at least one of the walls, the floor, and the ceiling comprise a mu-metal cladding.

* * * * *

UNITED STATES PATENT AND TRADEMARK OFFICE

CERTIFICATE OF CORRECTION

PATENT NO. : 8,844,221 B2
APPLICATION NO. : 13/466205
DATED : September 30, 2014
INVENTOR(S) : Urs T. Duerig et al.

It is certified that error appears in the above-identified patent and that said Letters Patent is hereby corrected as shown below:

In the Specification

Column 7, line 24, delete "31-38," and insert -- 31-36, --, therefor.

Column 7, line 37, delete "31 and 32," and insert -- 32 and 33, --, therefor.

Column 7, line 38, delete "31, 32," and insert -- 32, 33, --, therefor.

Column 7, line 41, delete "31, 32," and insert -- 32, 33, --, therefor.

Column 8, line 24, delete "6 and 7," and insert -- 8 and 9, --, therefor.

Column 8, line 27, delete "6 and 7," and insert -- 8 and 9, --, therefor.

Signed and Sealed this
Eighth Day of September, 2015

Michelle K. Lee

Michelle K. Lee
*Director of the United States Patent and Trademark Office*